US008826632B2

(12) United States Patent
Hastreiter et al.

(10) Patent No.: US 8,826,632 B2
(45) Date of Patent: Sep. 9, 2014

(54) PACKAGING MODULE FOR PACKS OR GROUPS OF ARTICLES TO BE WRAPPED IN FILM

(75) Inventors: Christian Hastreiter, Amerang (DE); Peter Koch, Seeon (DE)

(73) Assignee: Krones AG, Neutraubling (DE)

( * ) Notice: Subject to any disclaimer, the term of this patent is extended or adjusted under 35 U.S.C. 154(b) by 383 days.

(21) Appl. No.: 13/317,477

(22) Filed: Oct. 19, 2011

(65) Prior Publication Data

US 2012/0117923 A1 May 17, 2012

(30) Foreign Application Priority Data

Nov. 16, 2010 (DE) ..... 10 2010 051 324

(51) Int. Cl.
*B65B 13/10* (2006.01)

(52) U.S. Cl.
USPC ..... 53/399; 53/398; 53/441; 53/442; 53/589; 53/203; 53/210; 53/220

(58) Field of Classification Search
USPC ..... 53/397–399, 441, 442, 203, 209, 210, 53/220, 589
See application file for complete search history.

(56) References Cited

U.S. PATENT DOCUMENTS

| | | | | |
|---|---|---|---|---|
| 3,540,187 | A * | 11/1970 | Monaghan | 53/74 |
| 3,791,100 | A * | 2/1974 | Monaghan | 53/74 |
| 3,791,101 | A * | 2/1974 | Monaghan | 53/210 |
| 5,203,144 | A * | 4/1993 | Gambetti | 53/465 |
| 5,203,146 | A * | 4/1993 | Gambetti | 53/557 |
| 5,463,846 | A * | 11/1995 | Gambetti | 53/465 |
| 6,474,041 | B1 * | 11/2002 | Gambetti | 53/141 |
| 6,722,103 | B2 * | 4/2004 | Gambetti | 53/411 |
| 6,739,115 | B1 * | 5/2004 | Malini | 53/588 |
| 6,880,316 | B2 * | 4/2005 | Lancaster et al. | 53/588 |
| 6,964,147 | B2 * | 11/2005 | Gambetti | 53/465 |
| 7,328,554 | B1 | 2/2008 | Cerf | |
| 2004/0083689 | A1 | 5/2004 | Floding et al. | |
| 2005/0072123 | A1 | 4/2005 | Gambetti | |
| 2006/0096248 | A1 | 5/2006 | Duterte et al. | |

FOREIGN PATENT DOCUMENTS

| | | | |
|---|---|---|---|
| CN | 85105134 | | 12/1986 |
| DE | 4207758 | A1 | 2/1993 |
| DE | 296 08 343 | U1 | 9/1997 |
| DE | 100 37 714 | C1 | 1/2002 |
| DE | 20 2008 0074 | | 8/2008 |
| EP | 0629 551 | A1 | 12/1994 |
| EP | 0 581 747 | | 3/1996 |
| EP | 1 256 519 | | 11/2002 |
| EP | 1403181 | | 3/2004 |

* cited by examiner

*Primary Examiner* — Christopher Harmon
(74) *Attorney, Agent, or Firm* — Davidson, Davidson & Kappel, LLC

(57) ABSTRACT

A packaging module for wrapping packs or article groups with packaging film. The packs or article groups to be wrapped are transported in an upright position on a horizontal conveying device to a packaging station. A film wrapping device includes at least one wrapping rod extending perpendicular to the transport direction and is guided on both long sides of the horizontal conveying device by continuous traction devices.

The continuous traction devices each includes guiding sections that define the position and the deflection of the continuous traction device. The corresponding guiding sections of the two parallel continuous traction devices are adjustable pair wise in the same direction in their vertical and/or horizontal position and/or in their angular position about a pivot point.

14 Claims, 8 Drawing Sheets

Fig. 2A

PACKAGING MODULE FOR PACKS OR GROUPS OF ARTICLES TO BE WRAPPED IN FILM

This claims the benefit of German Patent Application DE 10 2010 051 324.5, filed Nov. 16, 2010 and hereby incorporated by reference herein.

The present invention relates to a packaging module for wrapping packs or groups of articles with packaging film. The invention furthermore relates to a corresponding method for wrapping packs or groups of articles with packaging film.

BACKGROUND

Usually packaging machines are used for the packaging of articles or article groups, especially packs. Thereby the packaging material is wrapped around the article groups by wrapping modules. The packaging machines comprise chains or cantilever beams with wrapping rods or carrier elements. The wrapping rods or carrier elements transport the pre cut packaging materials and wrap it around the articles. For example, rigid curve profiles are used. The curve profiles are customized according to the pack cargo dimensions and the required processing efficiencies. So called carrier chains are guided in the rigid curve profiles. Depending on the product and processing efficiency different contours are used. The contours therefore need to be replaced or changed accordingly. Furthermore it is known to use height adjustable contours as well as freely adjustable chain bases to produce an optimized processing curve.

DE 296 08 343 U1 describes a device used for wrapping film around a group of articles. Hereby a carrier rod is moved along a guidance that can be adjusted in its height.

EP 0 581 747 B1 describes a film wrapping module with a plurality of gears and a plurality of rails arranged perpendicular to the direction of movement. The film wrapping module can occupy different positions by adjusting the gears and the rails. This allows an adaptation to the articles to be wrapped in film.

DE 100 37 714 C1 describes a film wrapping module with at least one film carrier rod encircling a closed path. The path of the film carrier rod can be programmed freely thereby adjusting it to the articles to be packaged.

A film wrapping device 1 known from prior art is depicted in FIG. 1. The article group 5, which is to be wrapped, is fed to the film wrapping device 1 by a conveying device 10, for example a continuous conveyor 11. The wrapping chain 12 is guided over deflections 14, 14* in a contour 15 with chain bases 16.

The packaging material, especially the film 6, is guided over the carrier element 18 and wrapped around the article group 5. The wrapped article group 7 is then fed into further processing devices, for instance to a shrinking tunnel 2.

SUMMARY OF THE INVENTION

It is an object of the present invention to provide a device for the packaging of packs or article groups with packaging film, whereby the device can be adapted or adjusted easily, quickly and at a low cost according to different dimensions of the packaged goods and according to the different processing efficiencies.

The present invention provides a packaging module showing the subsequently described characteristics. The packaging module is used for wrapping packs or article groups with packaging film, for example with a heat shrinkable film. The packaging materials are moved within the film wrapping device with the help of wrapping rods or carrier elements and thereby wrapped around the articles.

The packs or groups of articles to be wrapped are transported in an upright position on a horizontal conveying device to a packaging station, for instance to a shrinking tunnel. During the transport in transport direction, the packs or groups of articles are wrapped and/or packaged into a film section of a defined length by the film wrapping device. The film wrapping device comprises at least one wrapping rod extending perpendicular to the direction of transport. The wrapping rod is guided on both long sides of the horizontal conveying device by continuous traction means. The film section is held and/or guided during the wrapping process by clamping means of the wrapping rod. The continuous traction means define a guiding contour for the wrapping rod. The continuous traction means each comprises guiding sections that define the position and the deflection of the continuous traction means. The guiding sections can have a defined length. According to an alternative embodiment the length of the guiding sections can be adjusted.

According to the invention the corresponding guiding sections of the two parallel continuous traction means can be adjusted pair wise in the same direction in their vertical and/or horizontal position. Furthermore the angular position of the corresponding guiding sections can be adjusted pair wise around a pivotal point.

By a variable adjustment of the guiding sections the height and/or length of the wrapping chain above the transport level as well as the guiding contour of the wrapping rod can be adapted flexibly and adjusted to the article group to be packaged and/or to the processing efficiency accordingly. The guiding contour especially represents the path traversed by the wrapping rod in the horizontal direction as well as in the vertical direction. Therefore an easy alignment of the guiding sections is possible, adapting the film wrapping device according to different article sizes and/or according to different processing efficiencies. The position of the guiding sections is for instance controlled electronically.

The corresponding guiding sections can be arranged either in the same or in the opposite direction to the transport direction. Furthermore the guiding sections can be adjustable in the transport direction or opposite to the transport direction.

According to a preferred embodiment the continuous traction means are roller chains, link chains or another suitable material.

The guiding sections are formed as guiding contours for the continuous traction means. The continuous traction means themselves form the guiding contours for the wrapping rod. According to another embodiment the guiding sections are formed as elongated supports for the traction means. The shape of the guiding sections can be designed variably for different applications. The guiding sections are made of any suitable material that allows a trouble free movement of the continuous traction means. The guiding sections can, for example, be designed as sliding elements made from plastics or something alike.

The guiding sections are located above the transport level and are preferably arranged pivotally. Their angular position can be adjusted by a movement about a pivot point. The pivoting of the guiding sections, which are arranged on one side each, may in particular occur in the same direction, in opposite directions etc. Thereby the chain length above the transport level can be influenced and adjusted. Furthermore the relative position of the article group at the time of the appearance and the descent of the carrier element can be influenced above and below the transport level.

Furthermore at least one chain tensioner can be provided below the transport level, to regulate the tension of the wrapping chain. Therefore a first function of the chain tensioner is to generate the required tension of the continuous traction means. Furthermore, the chain tensioner is used to compensate any excess chain above the transport layer that may result when the path of the wrapping chain is changed.

This is especially important to prevent a hanging of the wrapping chains, because then no proper guidance of the carrier rod would be possible.

According to a preferred embodiment the guiding sections can be adjusted cyclically during an ongoing operation of the film wrapping device. Depending on the incoming article group, a corresponding adjustment of the guiding sections is done to avoid a collision between the articles and the carrier rod.

It can be provided that the incoming articles on the horizontal conveying device are registered electronically by sensory means. The sensor can, for example, comprise an image-analysis system. The sensor detects, measures and/or identifies certain data, for instance the amount, height and width of the incoming article group. The acquired data is send to a computing unit. Based on this data the computing unit calculates the optimized guiding contour for the wrapping rod. The computing unit then controls the adjustment of the guiding sections and the chain tensioner if necessary. Preferentially the optimized guiding contour for the wrapping or carrier rod can be adjusted automatically with these adaptations, thereby preventing a collision between the articles and the wrapping rod.

The data obtained by sensory means can furthermore be used to calculate the required length of shrink film and deliver an appropriately matched section of film. Particularly, the computing unit can additionally control a film cutting device and cut the required film sections of appropriate size.

The invention furthermore relates to a method for wrapping packs or groups of articles with packaging film, especially with heat shrinkable film. The packs or groups of articles to be packed are transported upright on a horizontal conveyor in the direction of a packing station. The packaging station is for instance a shrink station. When conveyed in transport direction the packs or groups of articles are wrapped in a film section of a defined length by means of a film wrapping device. The film wrapping device includes continuous traction means for a wrapping rod, whereby the continuous traction means comprise guiding sections, which define the position and deflection of the continuous traction means. According to the invention the guiding contour formed by the continuous traction means is adjusted according to the packs or article groups to be packaged. The corresponding guiding sections of the two parallel continuous traction means are adjusted pair wise. Thereby the corresponding guiding sections are either adjusted in their vertical and/or horizontal position in the same direction. Alternatively or additionally the angular position of the corresponding guiding sections is adjusted about a pivot point. In particular, the part of the continuous traction means, which is located above the transport layer portion, can be adjusted in length according to the article groups to be packaged. Furthermore the shape of the guiding contour can be adjusted according to the article groups to be packaged.

According to a preferred embodiment the article groups approaching on the horizontal conveyor are detected by sensors. The data is transmitted to a computing unit that calculates the necessary guiding contour for the wrapping rod of the film wrapping device. Based on these data, the corresponding guiding sections of the two parallel arranged continuous traction means are controlled and adjusted accordingly. In particular, the corresponding guiding sections are adjusted pair wise in the same direction in their vertical and/or horizontal position and/or their angular position is adjusted around a pivot point. Furthermore, the tension of the continuous traction means can, for example, be adjusted by a chain tensioner.

The chain lengths of the wrapping chains in which the wrapping rod is guided are therefore crucial for processing the packaging film by the film wrapping device. With the described specific adjustment, especially due to the variable length adjustment of the wrapping chains in relation to the transport level, a variety of sizes of packaged goods and different processing efficiencies can be realized.

According to a preferred embodiment a support structure comprising at least one chain guidance element is provided. The chain guidance element can be adjusted at an angle about a pivot point. The chain guidance element can additionally be adjusted in its guiding length.

The position of the chain guidance element pivot points can be freely adjustable within a support structure. In another embodiment the position of the chain guidance element pivot points can be fixed. Furthermore at least two guiding system elements can be connected. Alternatively single angle and length adjustable points can be omitted if necessary, especially if required by the product to be processed in combination with the required processing efficiency.

At least one carrier element is mounted on the wrapping chains. The carrier element carries the packaging material and applies it to the packaged goods. Because the angle of the guiding sections can be adjusted, the length of the wrapping chain and the path of the wrapping chain are changed above the transport layer.

The curves influence the possible range of products to be processed. The curves furthermore influence the processing security of the wrapping process with the packaging material. When the deflection point is located higher above the transport layer, the chain path is increased, which changes the film transport by the wrapping rod in relation to the position of the pack.

Smaller packs require shorter film sections. Therefore the film section remaining behind the deflection point might be too short and therefore easily lost by the carrier element. With a selective angular adjustment the chain path above the transport layer can be shortened, thereby preventing a loosening of the film behind the deflection of the carrier element.

Additionally the chain length can also be influenced by shortening the chain length of the guiding sections above the transport layer. In this way the chain path can be adapted according to different heights of packaged goods.

With this invention the safe processing of different packaging geometries is possible. For example, combinations of large and small packaged goods can be processed with the same wrapping chain lengths or equal bar divisions of the chain.

Furthermore the position of the wrapping rod in relation to the packaged goods can be influenced by selectively delaying the wrapping chain in the transport direction. This can be used to optimize the wrapping of the packs.

The angle of the wrapping chain in relation to the transport layer can be varied through the angular adjustment in combination with the length adjustment of the chain guidance element. Thereby the danger of a collision between the pack and the wrapping rod during critical wrapping operations can be avoided.

BRIEF DESCRIPTION OF THE DRAWINGS

In the following, embodiments of the invention illustrated by the accompanying figures are used to explain its advantages. The relative sizes of the individual elements in the corresponding figures are not always in real proportions. Some forms are simplified and other forms are enlarged in relation to other shown elements for the sake of clarity.

FIGS. 2 and 2*a*, FIG. 3, FIG. 4, FIG. 5 and FIGS. 6*a* and 6*b* each represent different configurations of a film wrapping module according to the present invention, while

DETAILED DESCRIPTION

Figure 1:
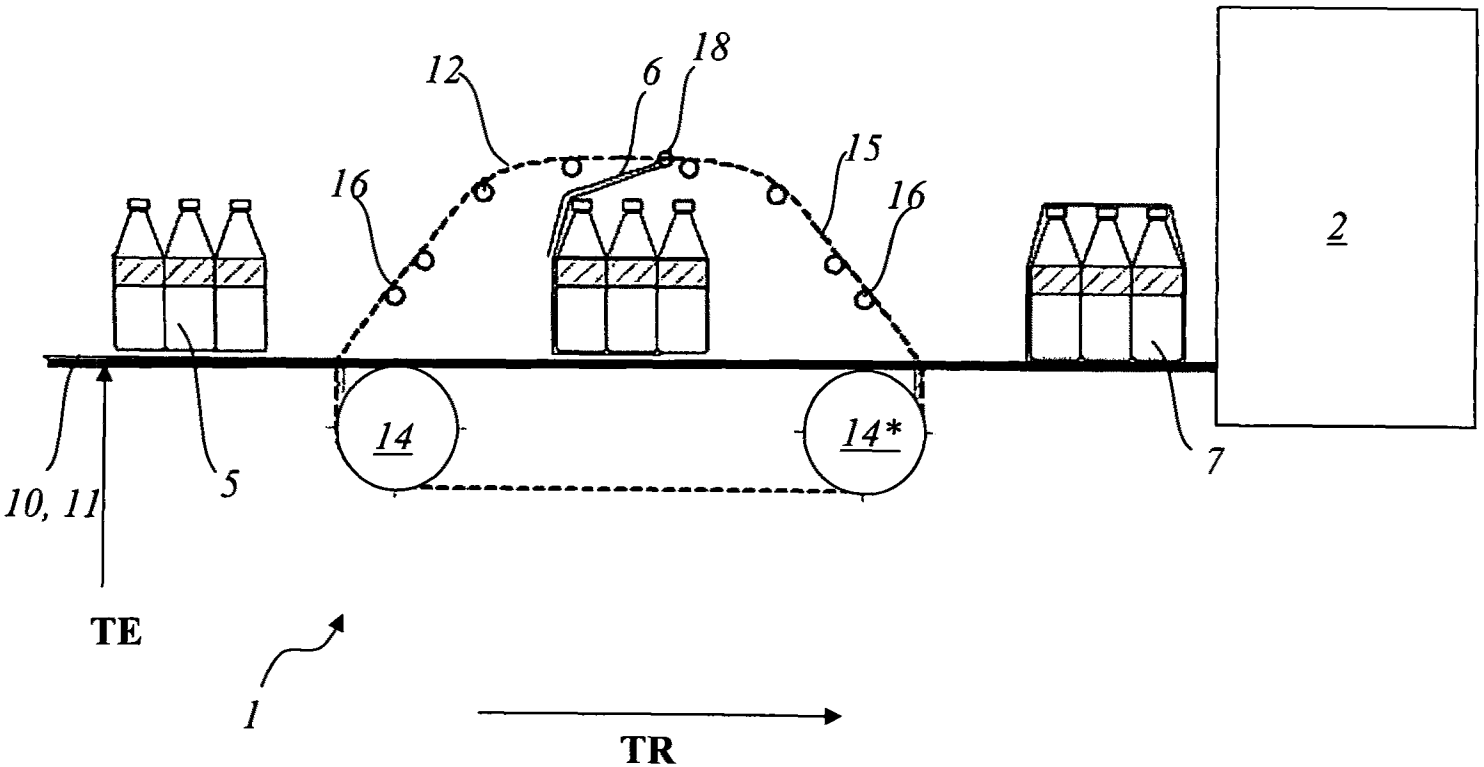
Fig. 1 (Prior Art)
FIG. 1 schematically illustrates a film wrapping module according to the known prior art.

For the same or equivalent elements of the invention, identical reference numerals are used. Furthermore, for the sake of clarity, in the various figures only reference numerals are represented, which are necessary for the description of each figure. The illustrated embodiments are merely examples of how the inventive device or method of the invention can be designed and do not constitute final limitations.

Figures 2, 2A:
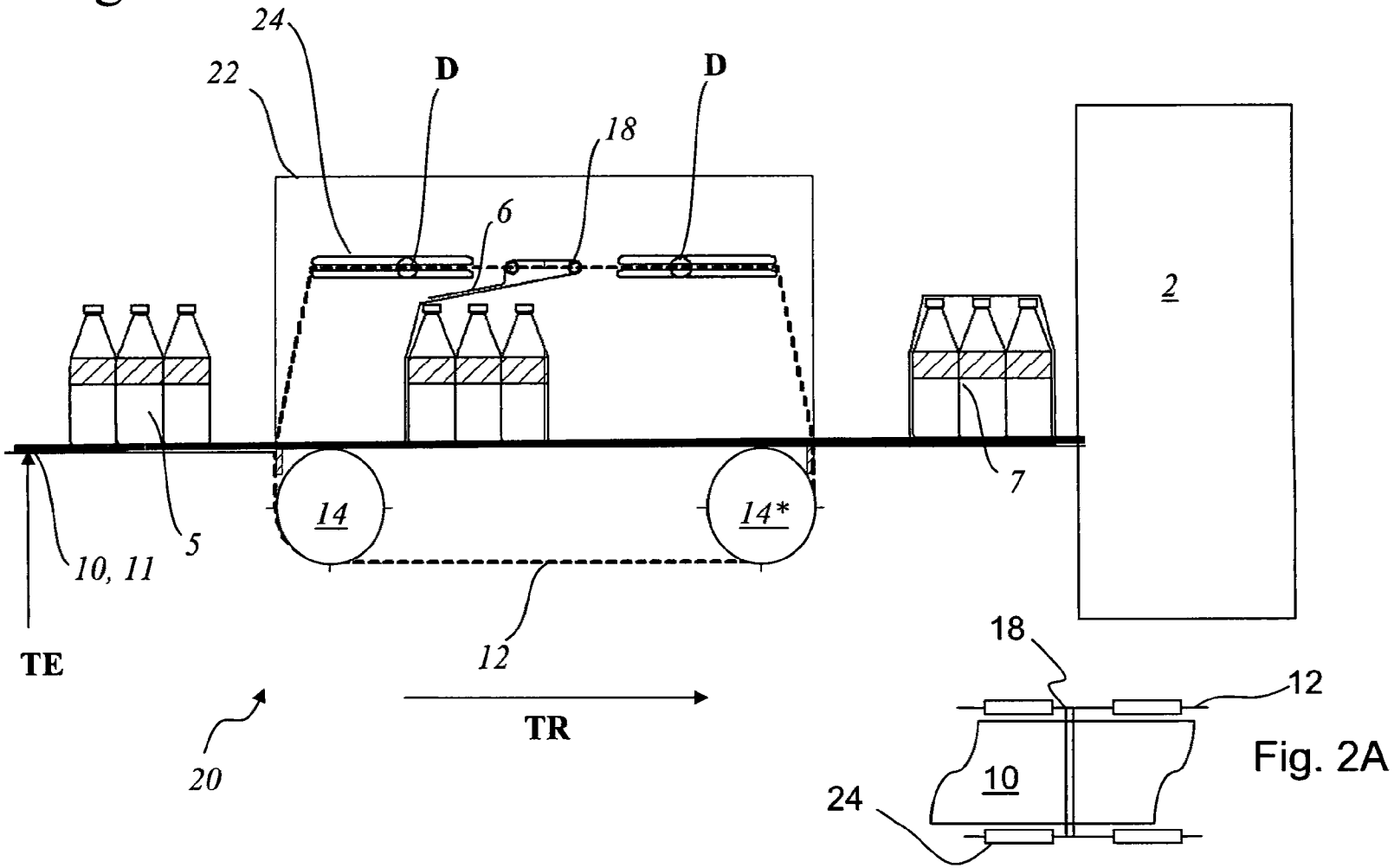

FIG. 2 shows a first embodiment of a film wrapping device 20.

The articles 5 to be processed in the film wrapping device 20 are first arranged or grouped together in the desired number and/or combination in a grouping station. Subsequently, the article groups 5 are transported via a horizontal conveyor 10 in the transporting direction TR to the film wrapping device 20. For instance an endless conveyor belt 11 can be used as horizontal conveyor 10. In the film wrapping device 20 the article groups 5 are wrapped in shrinking film 6. Subsequently the wrapped article groups 7 are fed to a further processing device, especially into a shrinking tunnel 2.

The film wrapping device 20 includes a support 22 which comprises at least one chain guidance element or at least one guiding section 24. In particular, the film wrapping device 20 includes at least one carrier element 18, also called wrapping rod. The carrier element 18 extends perpendicular to the transporting direction TR and is guided along the two long sides of the horizontal conveyor 10, 11 by wrapping chains 12. The film 6, which is wrapped around the article group 5, is guided and held by the wrapping rod 18 during the wrapping process.

The film wrapping device 20 furthermore includes at least one guiding section 24, which is adjustable at an angle about a pivot point D. In addition the guiding length of the guiding section 24 can also be adjusted.

In all examples shown here, two guiding section 24 are provided for each wrapping chain 12. Therefore actually four guiding sections 24 are provided, as shown schematically in the top view of FIG. 2*a*, because always two guiding sections 24 parallel to each other are arranged on the two long sides of the horizontal conveyor 10. The two guiding sections 24 on one side of the horizontal conveyor together with the respective wrapping chain form the guiding contour for the film carrier element 18.

By changing the angle of the guiding sections 24 above the transport layer TE, the length of the wrapping chain 12 and the path of the chain 12 itself is changed above the transport layer TE. The shape of the curves influences the possible range of products that can be processed and the processing security of the process of wrapping products with a packaging material 6. If the deflection point (see also FIG. 3) in the entry area for the articles is arranged higher above the transport layer TE, then the path of the chain 12 above the transport layer TE is elongated. This changes the film pull-off by the carrier element or wrapping rod 18 relative to the position of the article group 5.

Figure 3:
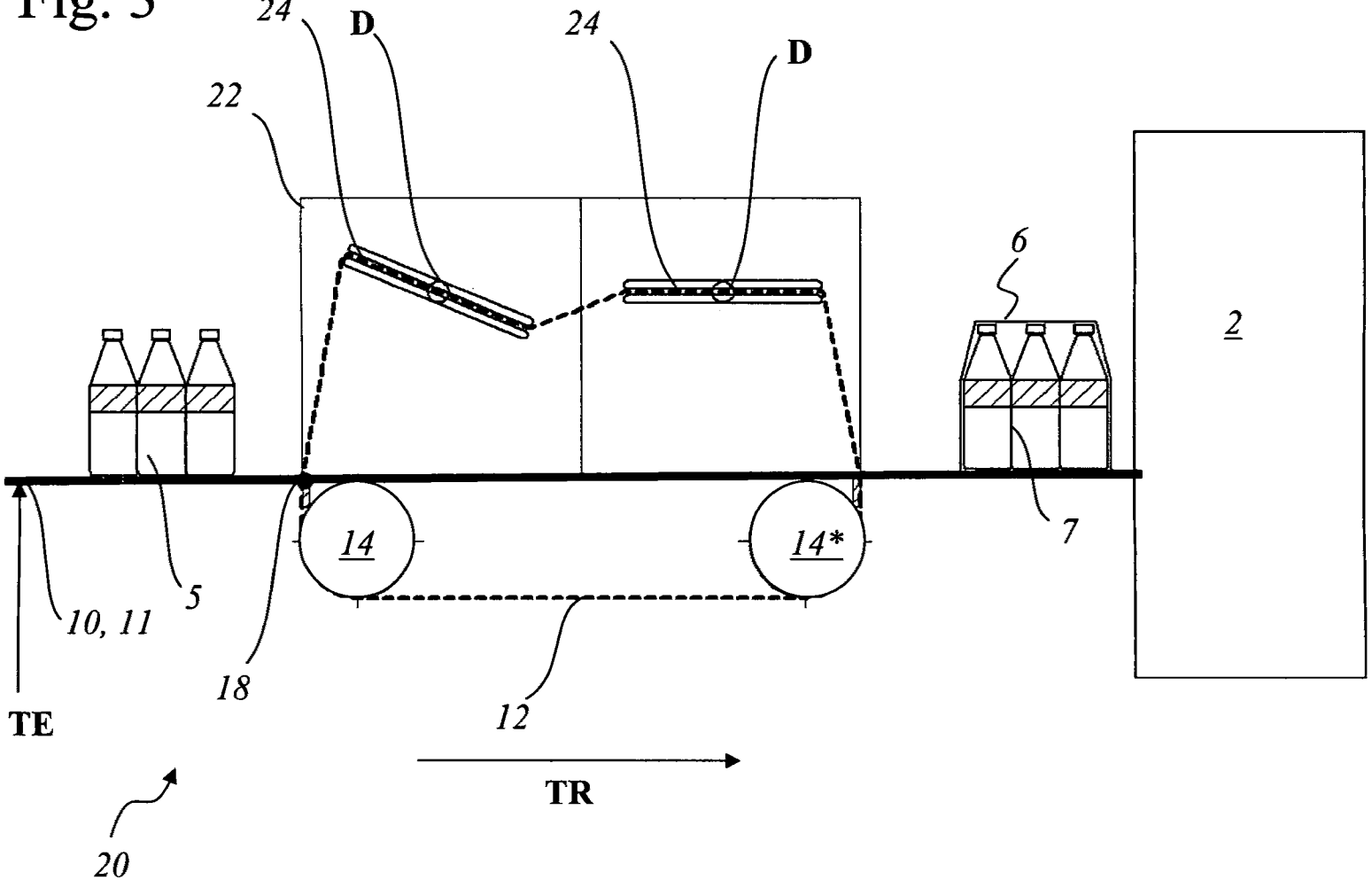
Figure 4:
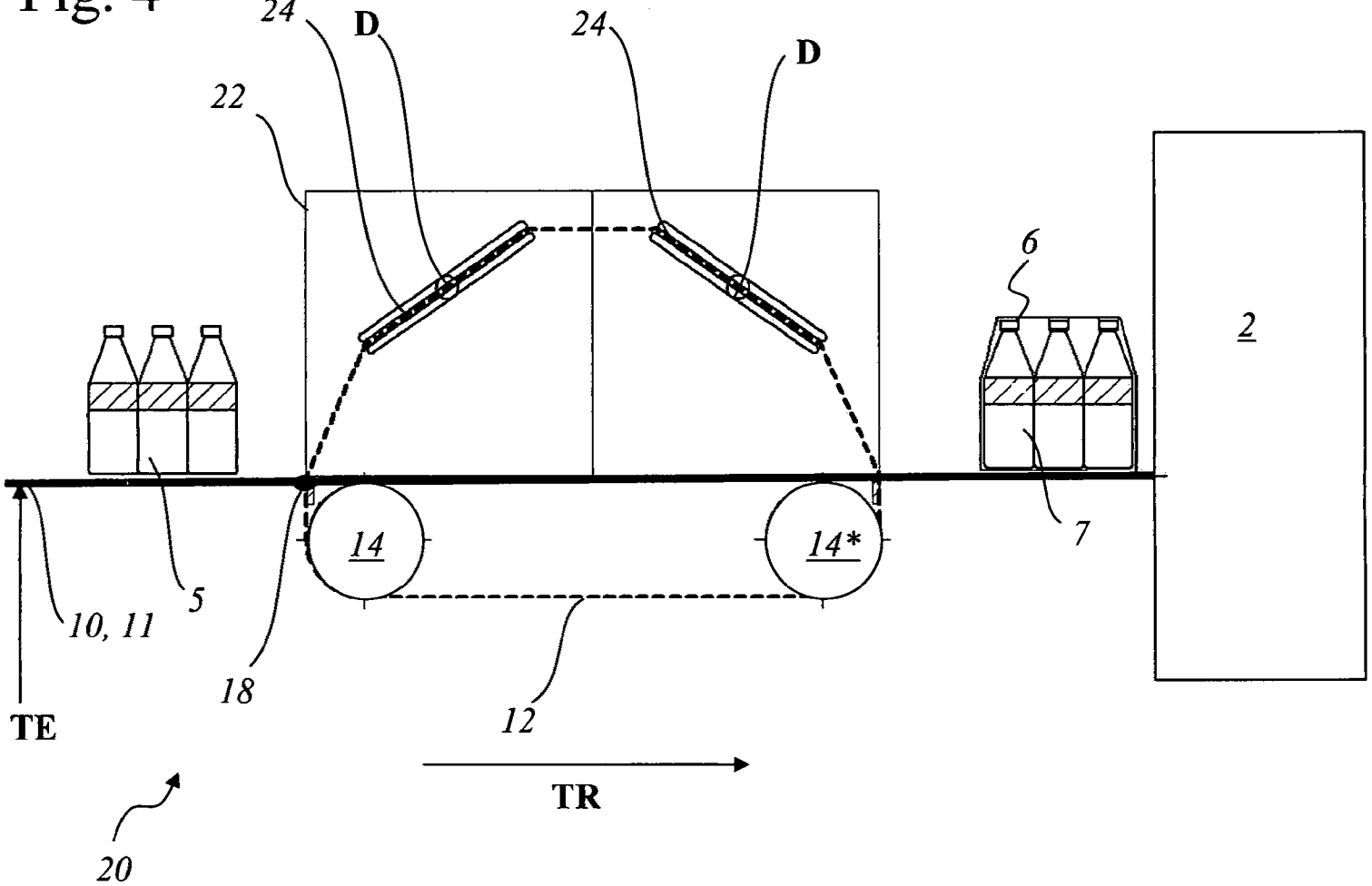
Figure 5:
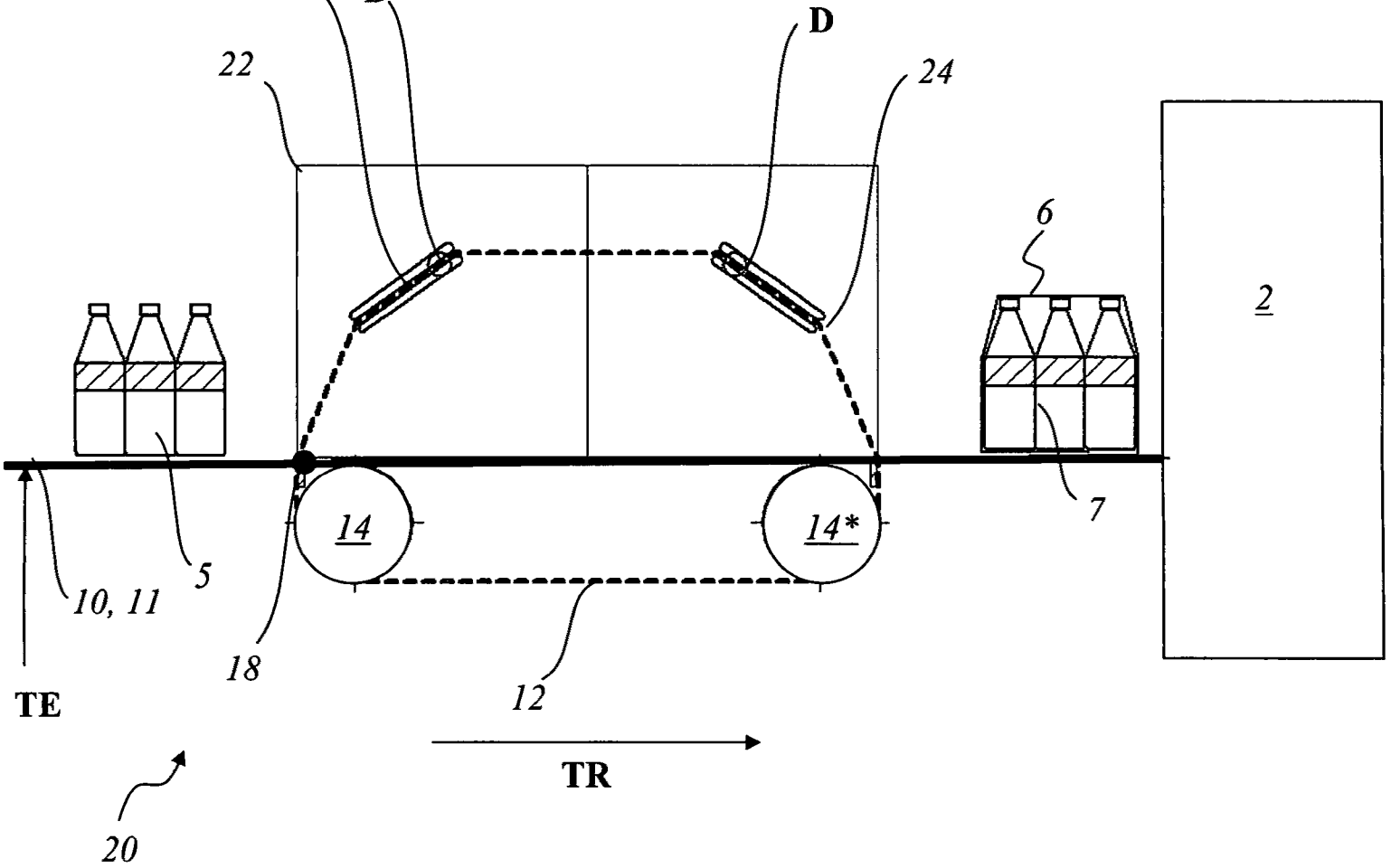

FIGS. 3 to 5 show various possibilities of an adjustment of the guiding sections 24. For smaller groups of articles 5 that require shorter film sections 6, the path of the wrapping chain can be reduced above the transport layer TE by a selective angular adjustment of the guiding sections 24. A short film remnant is easily lost. With the adjustment the danger of loosening the film 6 behind the deflection of the carrier element 18 can be avoided (FIG. 4, film remnant not shown).

The chain length above the transport layer TE can be additionally influenced by shortening the guiding elements 24. Thereby the chain length can be adapted to different package heights (FIG. 5).

With this invention it is possible to safely process a lot of different packaging geometries. For example, combinations of large and small article groups 5 can be processed with equal lengths of the wrapping chain 12 and/or with equal divisions of the carrier chain 12.

The position of the wrapping rod 18 relative to the article group 5 to be packaged can, for example, be influenced by selectively delaying the path that is run by the carrier element 18 in the wrapping chains 12 in transport direction TR (repositioning of a deflection see FIG. 3). This is especially used in order to optimize the wrapping of the article group 5.

Figure 6A:
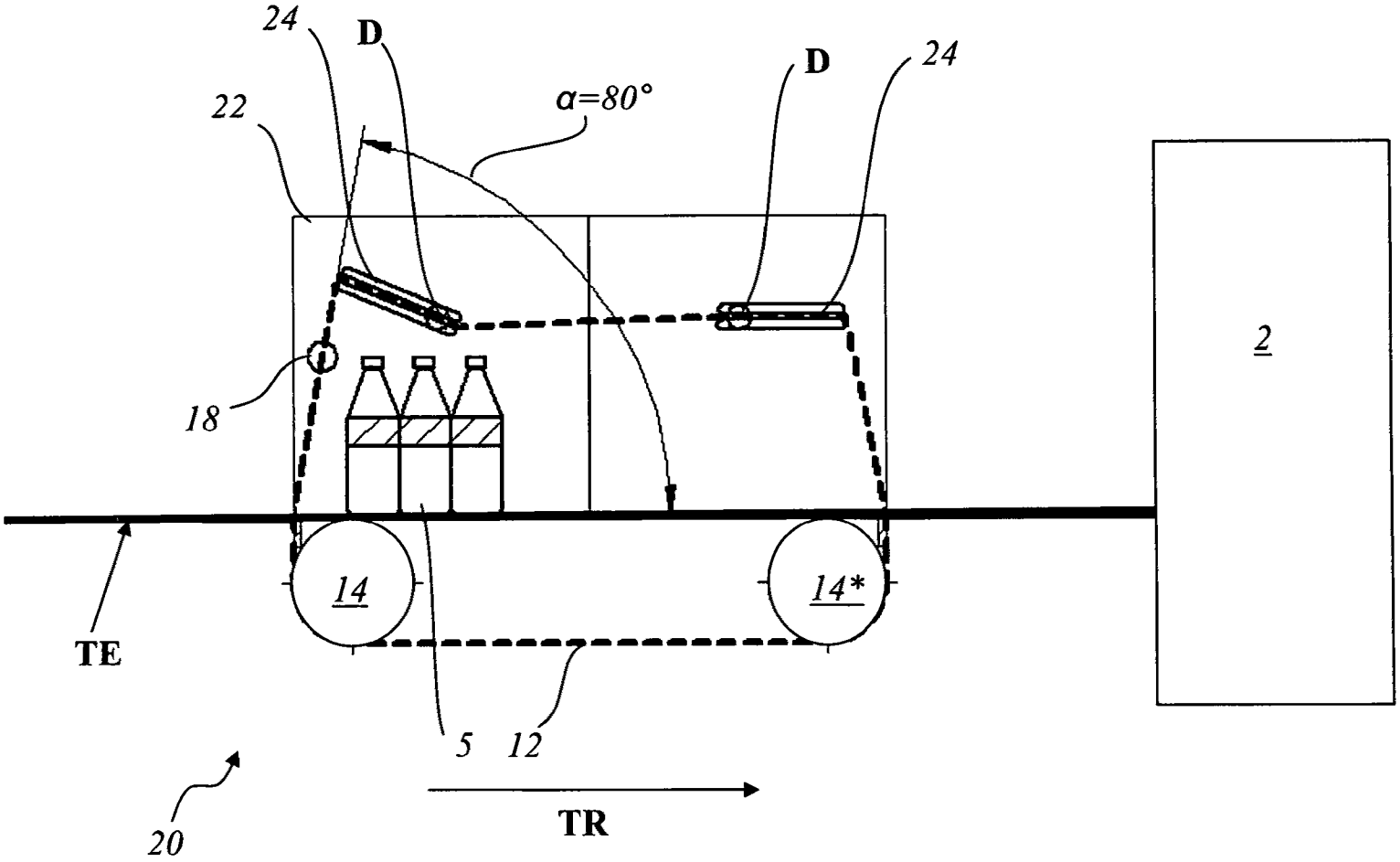
Figure 6B:
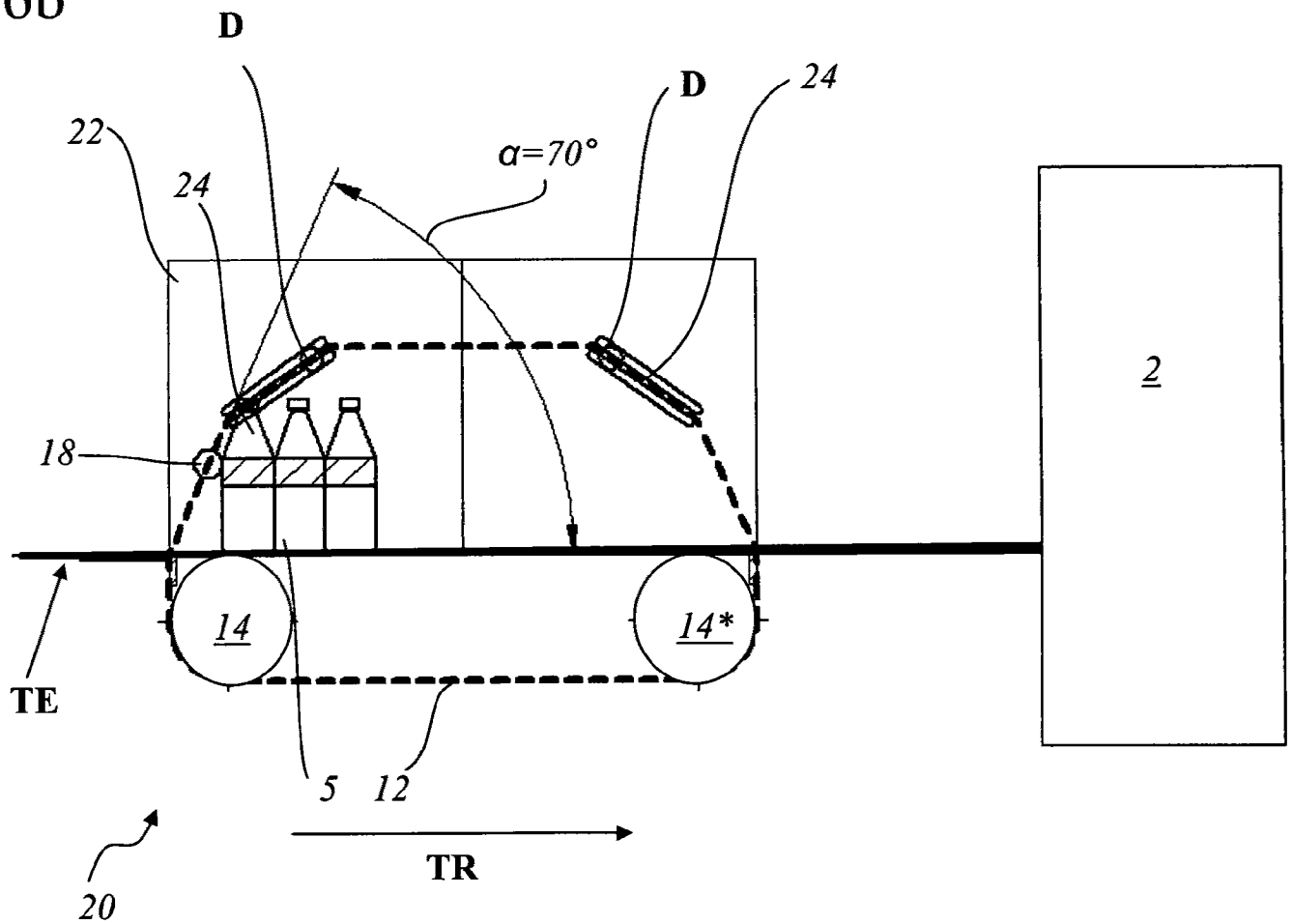

FIGS. 6*a/b* represent the possibility of an angular adjustment of the guiding sections 24. The angle of the chain 12 relative to the transport layer TE can be varied in combination with the length adjustment of the chain guidance element. It is therefore possible to avoid the danger of a collision between the article group 5 and the wrapping bar 18 during critical operations (see FIGS. 6*a* and 6*b* especially in view of the carrier element 18).

Figure 7:
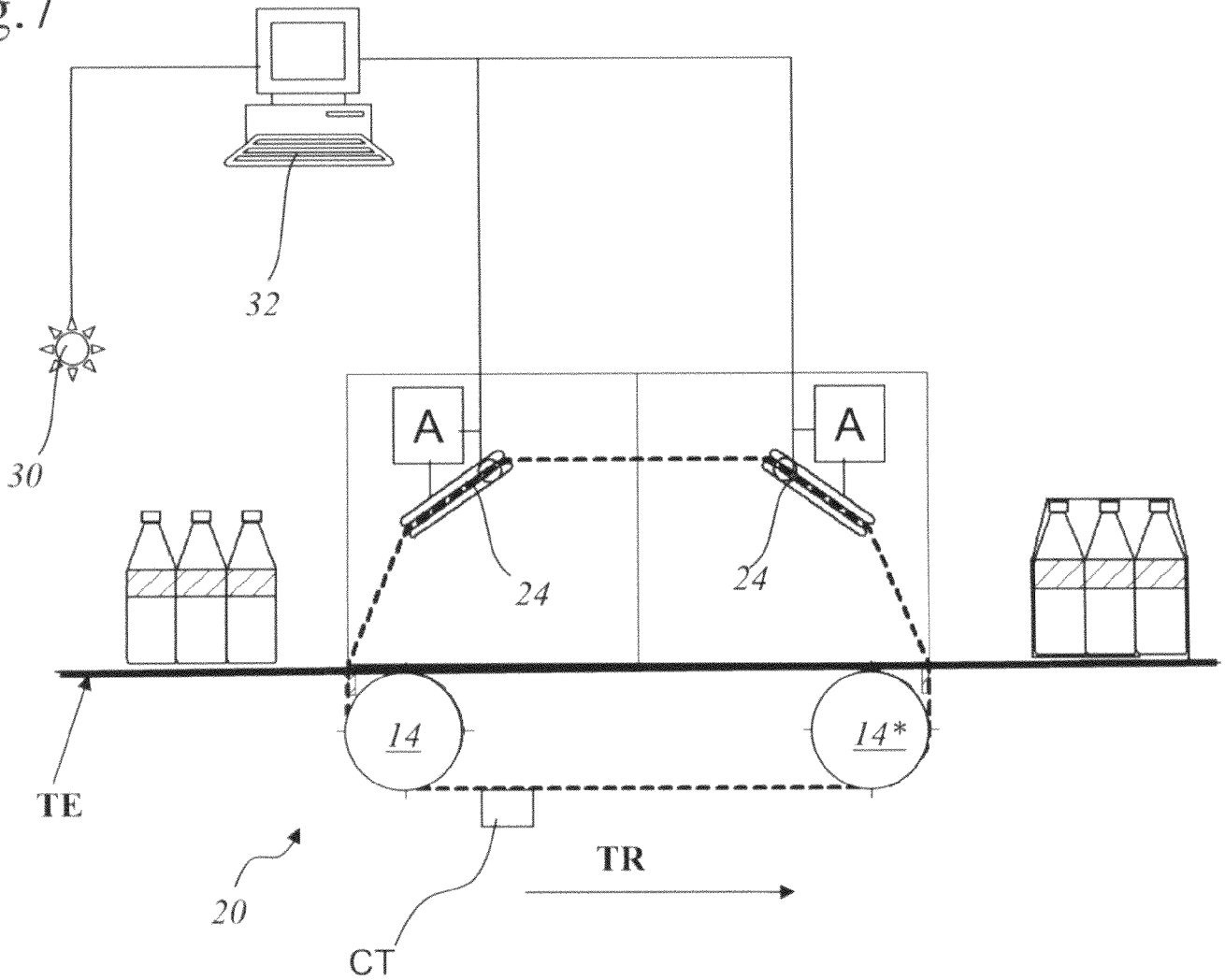
FIG. 7 shows the film wrapping module with sensory detection.

FIG. 7 shows the sensory detection of the approaching articles group 5, which is to be wrapped and packaged, by a sensor 30. As sensor 30 an image-analysis system may be used. The sensor 30 transmits the acquired data, in particular the number, height and width of the incoming article group 5, to a computing unit 32. Based on the transmitted data the best guiding contour for the wrapping rod or carrier element 18 is calculated. The computing unit 32 then controls the corresponding adjustment of the guiding sections 24, for example via actuators A, and for example via a common bar or two actuators acting in tandem can control corresponding pairs on either side of the conveyor 10 pairwise. The computing unit 32 can furthermore control a chain tensioner CT located below the transport layer. Thereby the optimized guiding contour for the wrapping rod 18 is set, preventing a collision between the wrapping rod 18 and the articles group 5.

The invention has been described with reference to preferred embodiments. However it is conceivable to one skilled in the art that variations or modifications of the invention can be made without departing from the scope of the following claims.

LIST OF REFERENCE NUMERALS

1 film wrapping device
2 shrinking tunnel
5 article group
6 Film
7 wrapped article group
10 conveying device
11 continuous conveyor
12 wrapping chain/continuous traction means
14, 14* chain deflection
15 Contour
16 chain base
18 carrier element/wrapping rod

20 film wrapping device
22 support
24 guiding contour
30 Sensor
32 computing unit
CT chain tensioner
D pivot point
TE transport layer
TR transport direction
A actuator

What is claimed is:

1. A packaging module for wrapping packs or article groups with packaging film, comprising:

a horizontal conveyor transporting the packs or article groups in a upright position on the horizontal conveyor to a packaging station; and a film wrapper wrapping the packs or article groups being wrapped into a film section of a defined length during movement of the packs or article groups in a transport direction, the film wrapper comprising at least one wrapping rod extending perpendicular to the transport direction, the wrapping rod being guided on both sides of the horizontal conveyor by at least two continuous traction devices including a first continuous traction device and a second continuous traction device, the film section being clampingly held and/or guided during the wrapping process by the wrapping rod, the continuous traction devices guided in guidance contours defining a position and deflection of the continuous traction devices, each guidance contour comprising at least two guiding sections arranged in the transport direction, the guidance contours including a first guiding section and a second guiding section for guiding the first continuous traction device above the horizontal conveyor and a third guiding section and a fourth guiding section for guiding the second continuous traction device above the horizontal conveyor, the first and third guiding section being arranged in parallel and being adjustable pair wise either in the same direction in their vertical and/or horizontal position and/or each in an angular position about a pivot point and the second and fourth guiding section being arranged in parallel and being adjustable pair wise either in the same direction in their vertical and/or horizontal position and/or each in an angular position about a pivot point such that adjustment of the first, second, third and fourth guiding sections changes at least one of a length and a path of the first continuous traction device and the second continuous traction device above the horizontal conveyor, the first and third guiding sections being movable independent of the second and fourth guiding sections above the horizontal conveyor.

2. The packaging module as recited in claim 1 wherein the guiding sections of at least one of the guidance contours are arranged in the same direction as well as in the opposite direction to the transport direction.

3. The packaging module as recited in claim 1 wherein the guiding sections of at least one of the guidance contours are adjustable in the same direction as well as in the opposite direction to the transport direction.

4. The packaging module as recited in claim 1 wherein the wrapping film is a heat shrinkable film.

5. The packaging module as recited in claim 1 wherein the continuous traction devices include roller chains or link chains.

6. The packaging module as recited in claim 1 wherein the guiding sections are elongated supports.

7. The packaging module as recited in claim 1 wherein a length of the guiding sections is adjustable.

8. The packaging module as recited in claim 7 wherein the adjustable guiding sections of at least one of the guidance contours are arranged above a transport layer.

9. The packaging module as recited in claim 1 further comprising a chain tensioner arranged below the transport layer.

10. The packaging module as recited in claim 1 wherein the guiding sections include plastic sliding elements.

11. A method for wrapping of packs or groups of articles with packaging film, comprising:

transporting the packs or article groups in a upright position on a horizontal conveyor in a transport direction to a packaging station;

wrapping the packs or article groups into a film section of a defined length by a film wrapper during movement in the transport direction, the film wrapper comprising at least one wrapping rod extending perpendicular to the transport direction, the wrapping rod being guided on both long sides of the horizontal conveyor by at least two continuous traction devices including a first continuous traction device and a second continuous traction device, the continuous traction devices being guided in guidance contours defining the position and the deflection of the continuous traction devices, each guidance contour comprising at least two guiding sections arranged in the transport direction, the guidance contours including a first guiding section and a second guiding section for guiding the first continuous traction device above the horizontal conveyor and a third guiding section and a fourth guiding section for guiding the second continuous traction device above the horizontal conveyor; and adjusting a length and guidance contour of the continuous traction devices above the horizontal conveyor according to the shape and size of the packs or article groups to be packaged, the first and third guiding section being arranged in parallel and being adjusted pair wise in a same direction in a vertical and/or horizontal position and/or each in an angular position about a pivot point and the second and fourth guiding section being arranged in parallel and being adjustable pair wise either in the same direction in their vertical and/or horizontal position and/or each in an angular position about a pivot point such that adjustment of the first, second, third and fourth guiding sections adjusts the length and guidance contour of the first and second continuous traction devices above the horizontal conveyor, the first and third guiding sections being movable independent of the second and fourth guiding sections above the horizontal conveyor.

12. The method as recited in claim 11 wherein the guiding sections are adjustable in a same direction as well as in an opposite direction to the transport direction.

13. The method as recited in claim 11 wherein the packs or article groups to be packaged are detected by a sensor, recorded data being transmitted to a computing unit, a required guidance contour for the wrapping rod of the film wrapping device being calculated and the guidance contours being adjusted accordingly by an adjustment of the corresponding guiding sections of two parallelly arranged continuous traction devices, the guiding sections being adjusted pair wise in the same direction in their vertical and/or horizontal position and/or in their angular position about a pivot point and/or whereby the length of guiding sections is adjusted.

14. The method as recited in claim 11 wherein the guiding sections of the guidance contours are adjusted cyclically during ongoing operation.

* * * * *